United States Patent [19]

Perr et al.

[11] 4,038,956

[45] Aug. 2, 1977

[54] FLUID PRESSURE REGULATOR

[75] Inventors: Julius P. Perr, Columbus; Edward D. Smith, Greensburg; Harry L. Wilson, Columbus, all of Ind.

[73] Assignee: Cummins Engine Company, Inc., Columbus, Ind.

[21] Appl. No.: 504,047

[22] Filed: Sept. 9, 1974

[51] Int. Cl.[2] ..... F02D 1/04; F02D 1/06

[52] U.S. Cl. ..... 123/139 AF; 123/140 A; 60/39.28 T; 137/51

[58] Field of Search ..... 123/139 AF, 140 A, 140 FG, 123/140 MC; 60/39.28 T, 243; 137/47, 49, 51

[56] References Cited

U.S. PATENT DOCUMENTS

| | | | |
|---|---|---|---|
| 2,623,509 | 12/1952 | Gold et al. | 137/51 |
| 2,800,121 | 7/1957 | Fletcher | 123/140 MC |
| 3,048,013 | 8/1972 | Bevers et al. | 60/39.28 T |
| 3,054,254 | 9/1962 | Hopper | 60/243 |
| 3,078,670 | 2/1963 | Werner | 60/39.28 T |
| 3,107,623 | 10/1963 | Budzich | 123/139 AF |
| 3,168,084 | 2/1965 | Simonet | 123/139 AF |
| 3,446,015 | 5/1969 | Kimmel | 60/39.28 R |
| 3,514,946 | 6/1970 | Warne | 60/39.28 R |
| 3,574,475 | 4/1971 | Wolff | 60/39.28 R |
| 3,726,086 | 4/1973 | Herbstritt | 60/39.28 R |
| 3,777,479 | 12/1973 | Hagen | 60/39.28 R |
| 3,927,654 | 12/1975 | Perr | 123/140 A |

*Primary Examiner*—Carroll B. Dority, Jr.
*Assistant Examiner*—Paul Devinsky
*Attorney, Agent, or Firm*—Hibben, Noyes & Bicknell, Ltd.

[57] ABSTRACT

This disclosure deals with a variable fluid pressure regulator wherein the level at which the fluid pressure is regulated is adjustable. A member has a flow passage formed therein, and the fluid flows through the passage and out of the member, and a closure is positioned over the opening. The closure is yieldably mounted relative to the member and a spring urges the closure toward the opening. A recess or cavity is formed in the closure, and the fluid flows from the opening, into the recess, and then through a space between the closure and the member. The fluid pressure in the passage is a function of the spring force and the effective area of fluid pressure on the closure, and the effective area comprises the area of the opening plus any area of the recess which lies outside the margin of the opening. The regulated fluid pressure level may be varied by laterally shifting the closure relative to the opening in order to change the effective area.

15 Claims, 7 Drawing Figures

FLUID PRESSURE REGULATOR

Fluid pressure regulators commonly used in the past have included a passage for conducting the fluid to an opening, a closure positioned over the opening and a yieldable spring urging the closure toward the opening and tending to close the opening to the flow of the fluid. The yieldable spring produces a force on the closure and on the fluid, which resists the pressure of the fluid flowing out of the opening, and thereby maintains the fluid pressure in the passage at a certain level.

Variable pressure regulators have also been provided, such regulators including means to adjust the level of the fluid pressure in the passage. Such adjustment has been accomplished, for example, by providing means to vary the amount of the spring force acting on the closure.

The foregoing type of construction has disadvantages where it is desired to quickly adjust the pressure on a continuous basis in response, for example, to another variable, because it is frequently very difficult, or even impossible, to change the spring force as a function of the other variable. It is often also desired to be able to adjust the fluid pressure as functions of two variables, and this is even more difficult when using the foregoing structure.

It is therefore an object of the present invention to overcome the foregoinng disadvantages by providing a variable pressure regulator wherein the fluid pressure level may be readily adjusted in response to one or more variables.

A pressure regulator in accordance with the present invention comprises a housing member having an opening formed in a surface of said housing, a fluid passage formed in said housing member and leading to said opening, a closure member positioned adjacent said surface at said opening, spring means engaging said closure member and urging said member toward said surface so as to close said opening, a recess formed in the side of said closure member which faces said surface of said housing member and said recess being located adjacent said opening, fluid in said passage exerting pressure over an area of said closure member and moving said closure member away from said surface, thereby permitting the fluid to flow out of said opening, into said recess and then through the space between said surface and said closure, and means for shifting said closure member laterally of said housing member relative to said opening to thereby change the effective pressure area of the fluid on the closure member. The opening and the recess overlap but may be eccentrically located, and the effective area comprises the area of the opening plus the area of the recess which is not common to the area of the opening.

Means may be provided for automatically shifting said closure member and also for varying the force on it. A fuel supply system for an internal combustion engine may also be provided, wherein the pressure of the fuel is regulated in the foregoing manner and wherein the pressure level of the fuel is varied as a function of an operating parameter of the engine.

Other objects and advantages of the invention will be better understood from the following detailed description taken in conjunction with the accompanying figures of the drawings, wherein.

Figures 1, 2, 3, 4, 7:
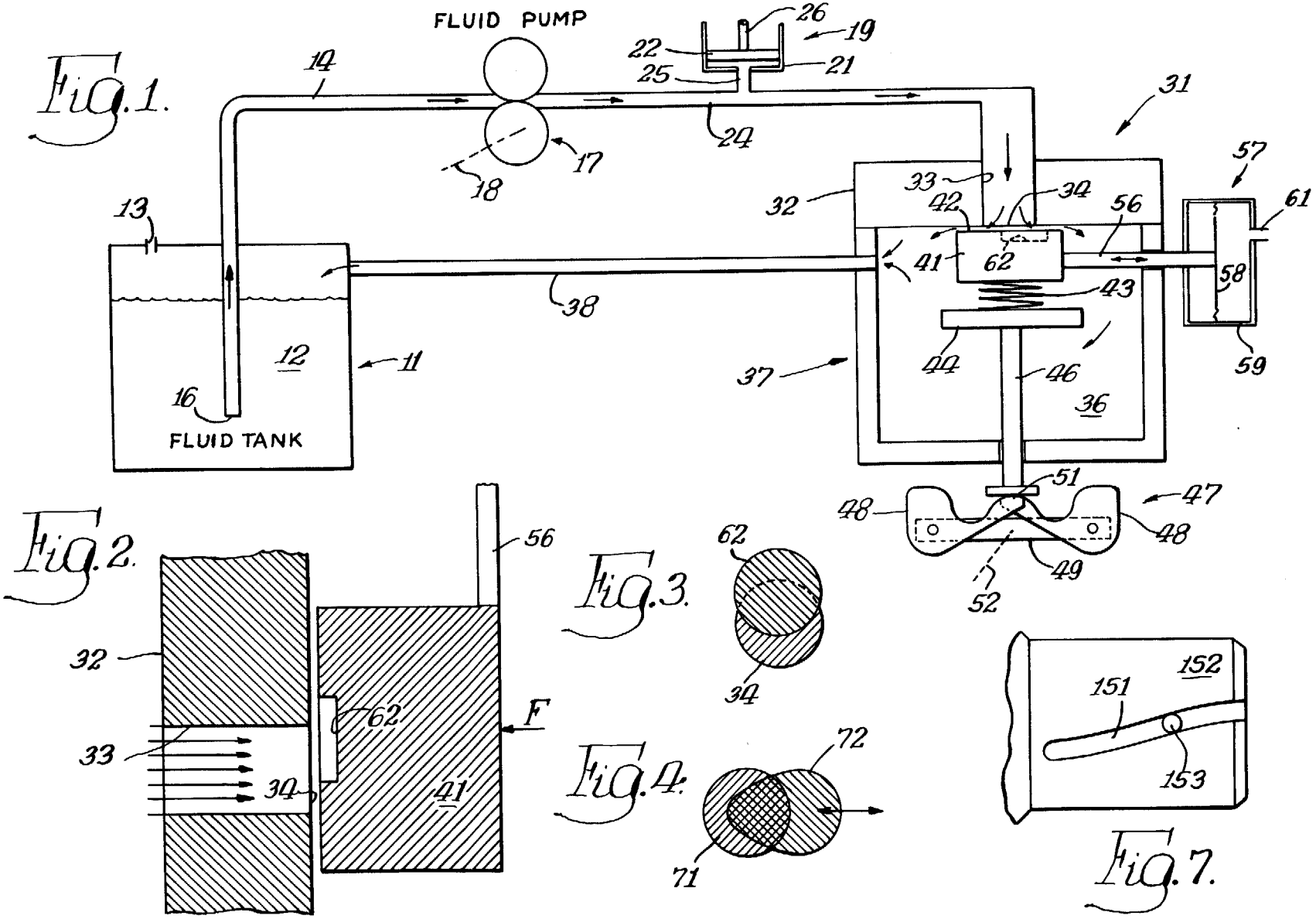
FIG. 1 is a schematic diagram of a system including a variable pressure regulator in accordance with the invention.
FIG. 2 is an enlarged fragmentary view of a portion of the regulator.
FIG. 3 is a schematic diagram illustrating the operation of the regulator.
FIG. 4 is a schematic diagram similar to FIG. 3 but illustrating an alternate form of pressure regulator.
FIG. 7 is a fragmentary enlarged view of a portion of the apparatus shown in FIG. 6.

The system illustrated in FIG. 1 includes a fluid supply tank or reservoir 11 containing a quantity of fluid 12. An air vent 13 may be formed in the upper end of the reservoir 11. A fluid line or conduit 14 extends through the wall of the reservoir 11 and the lower end 16 of the conduit 14 extends into the fluid 12. The conduit 14 is connected to the intake of a fluid pump 17 which, in the present illustration, is a gear pump. The pump 17 is connected by a mechanical coupling 18 to be driven in order to pump fuel from the reservoir 11 and through the conduit 14. The output of the gear pump 17 is connected by a line 24 to a utilizing device 19 which, in the present instance is a cylinder 21 having a piston 22 movably mounted therein. The space between the piston 22 and the cylinder 21 is connected by a line 25 to the line 24, and is filled by fluid from the line 24. The position of the piston 22 will of course be a function of the pressure of the fluid in the line 25. A link 26 may be connected to the piston 22 and coupled to operate a device (not shown) which will function in accordance with the pressure of the fluid in the line 24.

It should be understood that the cylinder 21 and the piston 22 are shown by way of illustration only, and that any other type of device may be used, which will operate in response to the pressure of the fluid in the line 24,.

A fluid pressure regulating device 31 is also connected to the line 24 for controlling the pressure of the fluid in the line 24. The device 31 comprises a housing 37 including a member 32 having a flow passage 33 formed therein, one end of the passage 33 being connected to receive the fluid from the line 24. The outer end of the passage 33 forms an opening 34 in the member 32, and fluid flowing through the passage 33 and out of the opening 34 flows into the interior 36 of the housing 37. A return or bypass line 38 is also connected to the housing 37, and fluid passing into the interior 36 flows through the return line 38 to the reservoir 11 and is returned to the supply 12.

Mounted within the interior 36 of the housing 37 and over the opening 34 is a closure member 41 which has one side 42 facing the opening 34. The closure member 41 is urged in the direction of the member 32 by a force produced by, in the present illustration, a spring 43 which is located between the closure member 41 and a support 44. The support 44 is also movably mounted in the interior 36 and is connected by a rod 46 to a centrifugal mechanism 47 including two weights 48 which are pivotally mounted on a support 49. Surfaces 51 of the weights 48 bear against the outer end of the rod 46. Upon rotation of the support 49, the weights 48 pivot on their pin supports and move the rod 46 and the support member 44 in the direction of the member 32, and thereby increase the force exerted by the spring 43 on the closure 41. The support member 49 is connectable by a mechanical coupling, indicated schematically by the dashed line 52, to be rotated, and the amount of force exerted on the closure member 41 by the spring 43 will be a function of the rate of rotation of the centrifugal mechanism 47.

In addition to being movable toward and away from the frame member 32, the closure member 41 is also movable laterally of the opening 34. This is accomplished by a mechanical link 56 which is fastened to the closure member 41 and extends out of the wall of the housing 37. The outer end of the link 56 is connected to a transducer 57 which, in the present illustration, translates fluid, such as air or water, pressure into movement of the link 56. The outer end of the link 56 is connected to a diaphragm 58 of the transducer 57, the diaphragm being supported in a transducer housing 59. One side of the diaphragm is exposed through a passage 61 to a fluid under pressure, and the housing 59 on the other side of the diaphragm 58 may be either evacuated or maintained at a fixed pressure. When fluid under pressure is admitted to the interior of the housing 59 through the passage 61, the diaphragm 58 flexes by an amount which is a function of a fluid pressure, such flexing of the diaphragm 58 shifting or moving the link 56 and the closure member 41 relative to the opening 34. The link 56 should be flexible to permit the member 41 to move toward and away from the member 32.

FIGS. 2 and 3 illustrate in greater detail the opening 34 of the member 32 and construction of the closure member 41. As shown in FIG. 3, the opening 34 is circular, and the closure member 41 has a recess or cavity 62 formed therein, the recess 62 also being circular in this example of the invention. The fluid flows from the passage 33, out of the opening 34 into the recess 62, through a narrow space between the members 32 and 41, and to the interior space 36. Of course, the fluid pressure in the passage 33 must be great enough to move the members 41 and 32 apart slightly before such flow can take place. The adjacent surfaces of the members 32 and 41 are flat around the opening 34 and recess 62. The recess 62 should always, at least partially, overlie the opening 34, and the closure memgber 41 should not be moved laterally far enough to completely uncover the opening 34.

The pressure of the fluid in the passage 33 may be calculated from the equation $P = F/A$ where P is the pressure of the fluid, F is the force exerted by the closure member 41 on the fluid, and A is the area of the member 41 which is exposed to the pressure of the fluid.

The force F is also the force exerted by the member 44 and the spring 33 against the member 41. The area A consists of the area of the opening 34 plus the portion of the recess 62 which lies outside the margin of the opening 34, or which is not common to the opening 34. Consequently, the effective area is dependent upon the location of the recess 62 relative to the opening 34, and the effective area may be changed by shifting or laterally adjusting the closure member 41 relative to the member 32 in order to change the location of the recess 62.

It will be apparent from the foregoing that the regulated pressure level of the fluid pressure P in the conduit 24 may be varied either by changing the speed of rotation of the centrifugal mechanism 47 or the pressure in the transducer housing 59, thereby making the pressure level vary as functions of two variables. Of course, if it is desired to make the pressure level vary only as a function of one of these variables, the other of the variables may be held constant. At a certain pressure level, the regulator operates in the usual manner to hold the pressure at that level. For example, if the pressure rises above the level, it moves the closure 41 back to increase the size of the space between the members 32 and 41, thus spilling more fluid and dropping the pressure to the above level.

The form of the invention illustrated in FIGS. 1, 2 and 3 illustrates an example where the opening 34 and the recess 62 both are circular. The configurations of the opening 34 and the recess 62 may of course be other than circular in order to produce a different pressure change characteristic with flexing of the diaphragm 58. FIG. 4 illustates an example of a different configuration of the recess. An opening corresponding to the opening 34 is generally circular and is indicated in FIG. 4 by the reference numeral 71. The recess of a closure member corresponding to the member 41 is however generally egg-shaped and is indicated by the reference numeral 72. It will be apparent that the change in the fluid pressure P with a change in the position of the recess 72 will be different for the configuration shown in FIG. 4 than for the configuration shown in FIG. 3. It should also be apparent that other configurations, both of the opening and of the recess, may be provided to obtain desired pressure characteristics.

As previously mentioned, the system shown in FIG. 1 illustrates a general application of the invention, and such an arrangement may be utilized in a fuel pressure regulating system for an engine as shown in Reiners U.S. Pat. No. 3,036,565, for example. In a system of the character shown in the above patent, the pressure regulating device 31 may be used in place of the pressure regulator 15 shown in the patent, and the line 25 leading to the device 19 of FIG. 1 may be connected to supply fuel to the throttle 16 shown in the patent. The centrifugal mechanism 47 of FIG. 1 may be connected to be rotated at a rate which is a function of the speed of the engine, and the pressure transducer 57 of FIG. 1 may be connected to respond to the intake manifold air pressure of the engine.

Figure 5:
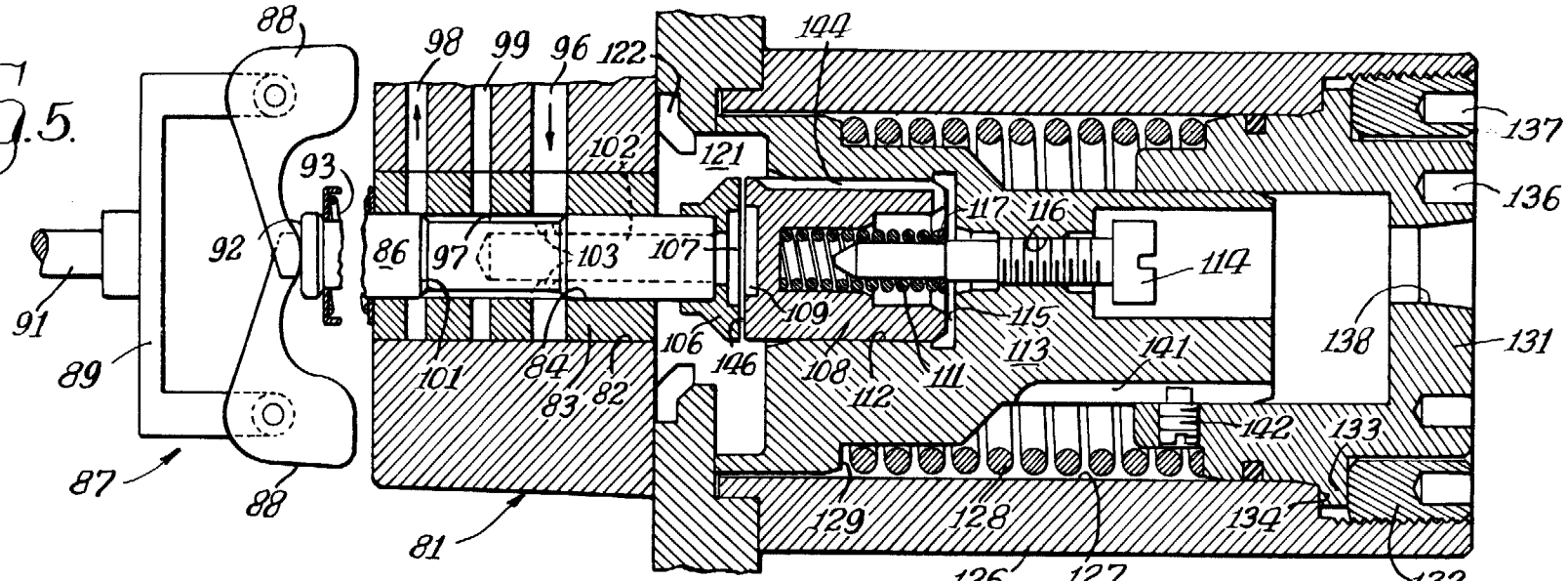
FIG. 5 is a sectional view of another form of apparatus including a pressure regulator embodying the invention.

FIG. 5 illustrates an application of the invention to a fuel supply system of the character disclosed in Reiners patent 3,159,152 dated Dec. 1, 1964. In the U.S. Pat. No. is disclosed a governor mechanism 41 for controlling the pressure of fuel flowing to a throttle and to fuel injectors of a compression ignition engine. The fuel supply system, of which the mechanism 41 forms a part, control the charge or quantity of fuel injected in each cycle by controlling the pressure of the fuel being supplied to the injectors. The mechanism 41 of the patent includes a closure 71, a spring 74 and an idle adjusting screw 102 for controlling the engine R.P.M. during idling.

The structure disclosed in FIG. 5 comprises a governor housing 81 having a sleeve bore 82 formed therein. The bore 82 receives a sleeve 83 which in turn has a plunger bore 84 formed therein. A plunger 86 is slidably mounted in the plunger bore 84, and is connected to be moved by a centrifugal mechanism 87. This mechanism comprises a pair of centrifugal weights 88 which are pinned to a support frame 89, the frame 89 being connected by a shaft 91 to be turned at a speed which is a function of the speed of the engine. Each of the weights 88 has one end thereof in engagement with the outer end 92 of the plunger 86, and it will be apparent that as the engine and the shaft 91 speed up, the weights 88 swing on their pivotal connections and move the plunger 86 inwardly or toward the right as seen in FIG. 5. When the engine slows down, springs 93, 111 and 128 retract the plunger 86 toward the left. Consequently, the position of the plunger 86 is a function of the speed of the engine.

The governor housing 81 includes a fuel intake passage 96 which receives fuel from a fuel supply pump (not shown in FIG. 5) which may be a supply pump similar to the pump 17 shown in FIG. 1. The passage 96 extends through the housing 81 and through the sleeve 83 to the plunger bore 84. The plunger 86 has a groove or reduced diameter portion 97 formed therein, and fuel flowing into the intake passage 96 flows into the space formed by the groove 97. The governor housing and the sleeve 83 also have formed therein an idle speed passage 98 and a high speed passage 99. The two passages 98 and 99 also extend through the governor housing 81 and through the sleeve 83 to the bore 84, and the passages 96, 98 and 99 in the sleeve 83 may be generally annular. The idle speed passage 98 is nearest the centrifugal mechanism 87 whereas the intake passage 96 is farthest from the centrifugal mechanism 87, the high speed passage 99 being between the passages 96 and 98. The edge 101 of the plunger 86, which forms the lefthand end of the groove 97, is located, when the engine is running at idle speed, adjacent the idle speed passage 98, the idle speed passage 98 being partially open as shown in FIG. 5. Consequently, during idling of the engine, fuel flows from the intake passage 96, into the space formed in the plunger bore 84 by the groove 97 and out of the governor housing 81 through the idle speed passage 98. As discussed in the previously mentioned U.S. Pat. No. 3,159,152, at idle speed of the engine, a throttle (not shown in FIG. 5 but shown in the patent) is turned to prevent flow from the high speed passage 99 to the injectors of the engine. Consequently, during idle speed the fuel flows into the intake passage 96 and out of the idle speed passage 98. To speed up the engine, the throttle is turned to permit fuel flow out of the passage 99, and the increased speed of the engine and the centrifugal mechanism 87 causes the plunger 86 to move toward the right and the edge 101 to close off the passage 98.

To regulate the pressure of the fuel flowing out of the idle speed passage 98 at a desired level during idling speed, a bypass passage is formed in the plunger 86, this passage being indicated by the reference numeral 102. The passage 102 extends axially of the plunger 86 from its right hand end as seen in FIG. 5 to the groove 97, and a plurality of radial passages 103 are formed in the plunger 86 from the passage 102 to the groove 97.

Fastened to the righthand end of the plunger 86 over the opening of the passage 102 is an adapter 106 which has a circular opening 107 formed therein. A closure 108 is positioned adjacent the adapter 106 and has a recess 109 formed in its side which faces the adapter 106. In the present example, the opening 107 and the recess 109 are circular, and the recess 109 is offset or eccentric relative to the opening 107. An idle spring 111 urges the closure 108 in the direction of the adapter 106. The closure 108 is mounted for sliding movement in a bore 112 formed in a guide 113, the righthand end of the closure 108 extending almost to the bottom surface 115 of the bore 112 during idle speed of the engine. The idle spring 111 is supported in the guide 113 by an idle adjusting screw 114, the screw 114 being threaded into an opening 116 formed in the guide 113. The washer 117 is fastened to the screw 114 and one end of the spring 111 is seated on the washer 117, the other end of the spring 111 bearing against the closure 108. An interior space 121 is formed in the governor housing around the guide 113 and a passage 122 is formed in the housing, the passage 122 extending to a return line corresponding to the line 38 in FIG. 1.

The guide 113 is supported by a spring housing 126 and by a stop 131, the housing 126 having a central cylindrical bore 127 formed therein. The left end of the bore 127 slidably supports the guide 113 and a spring 128 is positioned in the bore 127 between a shoulder 129 formed on the guide 113 and the stop 131, the spring 128 urging the guide 113 toward the left as seen in FIG. 5. The stop 131 is positioned in the righthand end of the bore 127 and is held in place by a retainer ring 132 which is threaded into the righthand end of the bore 127, a flange 133 formed on the stop 131 being located between the retainer ring 132 and a ledge 134 formed on the spring housing 126. Holes 136 and 137 are formed in the outer ends of the stop 131 and the retainer ring 132 so that the retainer ring 132 may be loosened by a spanner wrench (not shown), after which the stop 131 may be turned on its axis. A hole 138 is also formed in the stop 131 so that a screw driver (not shown) may be inserted into the housing in order to turn the idle adjustment screw 114.

The stop 131, the guide 113 and the closure 108 in the bore 112 are all circular in cross section, but the closure 108 is eccentric or off the center line of the stop 131 and the guide 113. The axis of the guide 113 is located downwardly, as seen in FIG. 5, from the axis of the bore 112 and the closure 108. Consequently, if the guide 113 is turned in the bore 127 on its axis, the retainer ring 132 of course having been loosened, the closure 108 will swing about the center line of the guide 113 and it will shift laterally of the opening 107 in the adapter 106.

As previously mentioned, the guide 113 is able to move axially in the bore 127 and it is connected to be turned along with the stop 131. This is accomplished by an axially extending groove 141 in the outer surface of the righthand end of the guide 113 and by a pin 142 fastened to the stop 131, the pin 142 extending into the groove 141. The groove 141 is axially elongated and therefore the guide 113 is able to move axially relative to the stop 131 but the pin 142 requires the guide 113 to turn when the stop 131 is turned. Consequently, if the retainer ring 132 is loosened and the stop 131 is turned as previously described, the pin 142 also turns the guide 113 and increases or decreases the eccentricity of the closure 108 relative to the opening 107 of the adapter 106.

As previously mentioned, the closure 108 also moves axially in the guide 113, and a slot or passage 144 is preferably formed in the outer surface of the closure 108 to permit the flow of fuel into and out of the space behind the closure 108 during such movement.

Considering the operation of the structure shown in FIG. 5, when the engine is not running, the centrifugal mechanism 87 is stationary and the springs 111 and 128 hold the plunger 86 in its extreme left position. The idle spring 111 holds the closure 108 against the adapter 106, and no fuel flows into the intake passage 96. When the engine is started, the centrifugal member 87 turns and the fuel pump supplies fuel to the intake passage 96. Since the centrifugal mechanism 87 is turning relatively slowly when the engine is first started and is running at idle speed, the idle passage 98 is opened by the edge or shoulder 101 of the plunger 86, the plunger 86 being substantially in the position shown in FIG. 5. Consequently, fuel flows from the intake passage 96, through the groove 97 and out of the governor housing through the idle speed passage 98. The fuel flowing through the groove 97 is under pressure due to the fuel pump which supplies fuel to the intake pressure 96. The fuel also flows from the groove 97 through the passages 103 and 102 and the fuel pressure is sufficient at idle speed of the engine to move the closure 108 toward the right against the force of the idle spring 111 to form a space or gap 146 between the adapter 106 and the closure 108 around the recesses 107 and 109. Consequently, fuel flows from the groove 97 through the passages 103 and 102, through the opening 107, the recess 109, the space 146 and out of the governor housing 81 through the passage 122.

As discussed in connection with FIG. 1, the force of the fuel in the passage 102 on the closure 108 is balanced by the force of the spring 111, and this force F is equal to the fuel pressure P times the area A over which it acts. The area A is equal to the area of the opening 107 plus the area of the portion of the recess 109, which lies outside the area of the opening 107, because this is the effective area of the closure 108 over which the fluid pressure acts. At a selected position of the closure 108, the effective area will be constant and the fluid pressure in the passage 102 will be maintained at a certain level proportional to the output of governor carrier assembly 87 minus the force of the sping 93. If the fluid pressure tends to rise, the closure 108 will be moved away from the adapter 106 and more fuel will be spilled or bypassed through the space 146, thus holding the pressure at the level mentioned above. The opposite of course occurs if the pressure level tends to drop. The pressure level may be changed by changing the effective area as previously described or by changing the spring force using the screw 114.

When, by adjustment of a throttle (now shown in FIG. 5) by an operator as described in connection with the system illustrated in U.S. Pat. No. 3,159,152, the speed of the engine is increased, the centrifugal mechanism 87 turns at a faster rate and moves the plunger 86 toward the right as seen in FIG. 5. Such plunger movement also causes the closure 108 to move toward the right, the space 146 being maintained by the pressure of the fuel in the passage 102, until the righthand end of the closure 108 meets the bottom 115 of the bore 112 formed in the guide 113. Thereafter, increased speed of the centrifugal mechanism 87 causing movement of the plunger 86 toward the right will cause the entire assembly of the closure 108, the guide 113 and the screw 114 to move toward the right against the force of the high speed spring 128. The axially extending groove or slot 141 formed in the guide 113 permits such axial movement of the guide 113 relative to the stop 131 without turning or impeding the movement of the guide 113. The operation of the remainder of the supply system is similar to that described in connection with the fuel supply system of U.S. Pat No. 3,159,152.

Figure 6:
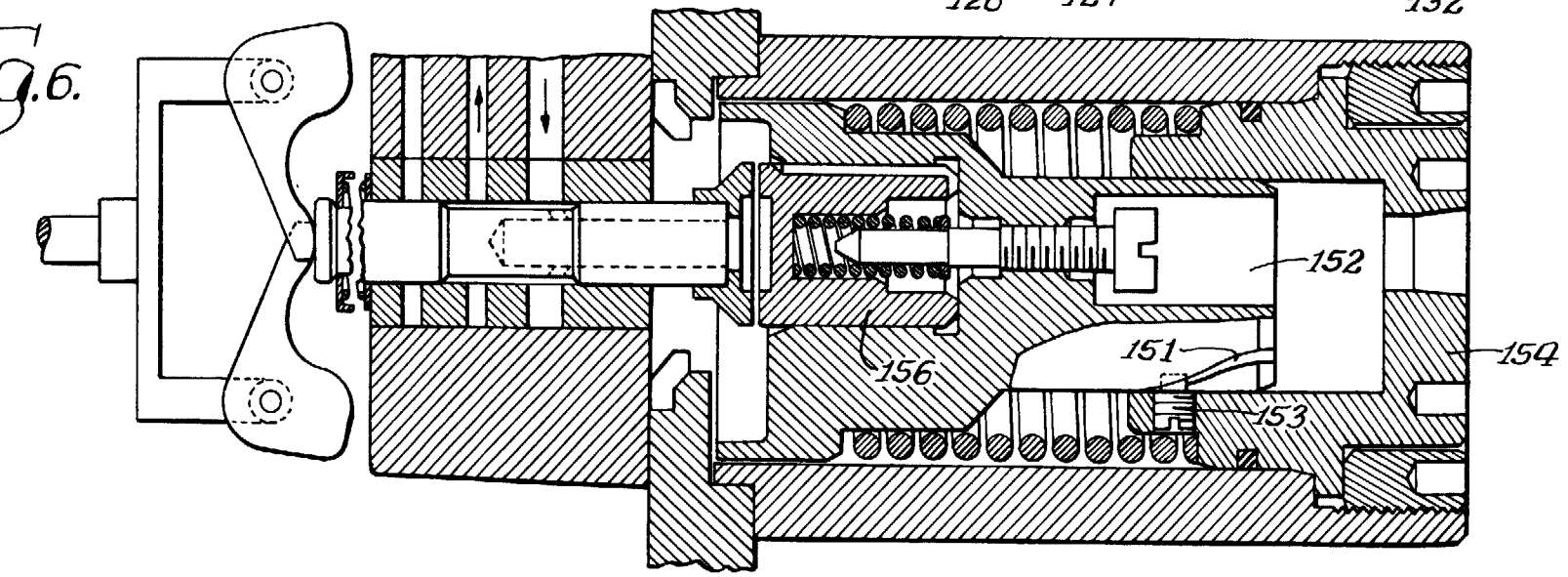
FIG. 6 is a view similar to FIG. 5 but showing another form of regulator.

The structure shown in FIGS. 6 and 7 is generally the same as the structure shown in FIG. 5, the only difference being in the form of the slot in the guide 113, which receives the pin 142. While the structure shown in FIG. 5 illustrates idling speed operation, the structure shown in FIG. 6 illustrates intermediate speed operation. In the structure shown in FIG. 6, a slot 151 is formed in the outer surface of a guide 152, the guide 152 being otherwise the same as the guide 113. The slot 151 is also shown in FIG. 7, and it will be apparent that the slot 151 curves slightly and extends both axially and circumferentially of the outer surface of the guide 152. A pin 153 is fastened to a stop 154, the pin 153 and the stop 154 being the same as the corresponding elements of the structure shown in FIG. 5. Due to the circumferential curve of the slot 151, as the guide 152 moves axially of the governor housing, the guide 152 will turn slightly on its axis. As previously described, the bore which receives a closure member 156 is eccentric relative to the axis of the guide 152, and consequently, the closure 156 will shift or swing laterally relative to the plunger as the guide 152 is moved axially relative to the stop 154 and the pin 153. Therefore, the effective area and the pressure level at which fuel is regulated will also vary with axial movement of the guide 152. Since the axial movement is due to increased or decreased speed of rotation of the engine, the regulated pressure level will vary with engine speed plus the shape of slot 151.

As mentioned previously, FIG. 5 illustrates a form of the invention where the effective area of the opening and the recess is adjustable but will remain at a selected value, whereas in the form of the invention illustrated in FIGS. 6 and 7, the effective area will vary during operation with speed. It will be apparent that means could, if desired, also be provided to turn the stops 131 and 154 and the guides 113 and 152 in response to some operating parameter of the engine. For example, a mechanism (not shown) may be provided which will respond to the intake manifold air pressure of the engine. Such a mechanism could be connected to turn the stops 131 and 154, assuming of couse that the retainer rings are loose enough to permit such movement.

It will be apparent from the foregoing description that a novel and useful pressure regulating apparatus has been provided. Pressure regulation is accomplished by varying the effective pressure area on a closure member, this being accomplished in a novel manner by forming a recess in the closure member and then shifting the closure member relative to a passage opening. Mechanisms have been described for effecting such a lateral shift of the closure member such mechanisms being either manually or automatically operated.

We claim:

1. In a fuel supply system for an internal combustion engine which burns a combustible fluid, the improvement of a fluid pressure regulator comprising a first member having a fluid passage formed therein and leading to an opening in a side thereof, said passage being adapted to receive fluid under pressure which flows through said passage and out of said opening, a closure member positioned adjacent said first member at said opening, means mounting said members for relative movement in a first direction toward and away from one another to form a space therebetween, force applying means engaging at least one of said members and urging said members toward one another so as to close said space, a recess formed in the side of said closure member which faces said first member, said recess at least partially overlying said opening, fluid in said passage exerting pressure over an area of said closure member and moving said closure member away from said first member to form said space therebetween and thereby to enable the fluid to flow out of said opening and through said space, and means mounting said members for relative movement in a second direction which is generally lateral of said first direction in order to vary the amount of said recess which lies outside of said opening, the pressure of the fluid in said passage being equal to the force of said force applying means divided by said area, and said area being equivalent to the area of said opening plus any area of said recess which lies outside the margin of said opening.

2. A fluid pressure regulator according to claim 1, where both said opening and said recess have a circular configuration.

3. A fluid pressure regulator according to claim 1, wherein at least one of said opening and said recess have a non-circular configuration.

4. A fluid pressure regulator according to claim 1, wherein said means mounting said members for relative movement in a second direction, comprises a transducer.

5. A fluid pressure regulator according to claim 1, wherein said force applying means includes apparatus for varying the amount of force applied to said closure member.

6. A fluid pressure regulator according to claim 5, wherein said apparatus comprises a centrifugal mechanism.

7. A fluid pressure regulator according to claim 1, wherein said first member is longitudinally movable toward and away from said closure member, and wherein said closure member and said force applying means are yieldable in response to such movements of said first member, and further including engine speed responsive means connected to said first member for moving said first member.

8. A fluid pressure regulator according to claim 7, and wherein said means mounting said members for relative movement in a second direction operates in response to said yielding movement of said closure member when said first member is longitudinally moved.

9. In a fuel supply system for an internal combustion engine which burns a combustible fluid, the improvement of a system for controlling fluid pressure in a fluid supply passage of said engine comprising a first member having a fluid passage formed therein and leading to an opening formed in a side thereof, pump means connected to said passage and adapted to pump fluid under pressure from a fluid supply through said passage and out of said opening, means connected to said passage and operating in response to the fluid pressure in said passage, a closure member positioned adjacent said first member at said opening, means mounting said members for relative movement in a first direction toward and away from one another to form a space therebetween, force applying means engaging at least one of said members and urging said members toward each other so as to close said space, a recess formed in the side of said closure member which faces said first member, said recess at least partially overlying said opening, fluid in said passage exerting pressure over an area of said closure member and moving said closure member away from said first member to form said space therebetween and thereby to enable the fluid to flow out of said opening and through said space, and means mounting said members for relative movement in a second direction which is generally lateral of said first direction in order to vary the amount of said recess which lies outside of said opening, the pressure of the fluid in said passage being equal to the force of said force applying means divided by said area, and said area being equivalent to the area of said opening plus any area of said recess which lies outside the margin of said opening.

10. A control system according to claim 10, and further including a return line adapted to return fluid flowing out of said opening to said supply.

11. A control system according to claim 9, wherein said force applying means comprises a resilient spring which engages said closure member.

12. A control system according to claim 11, and further including a centrifugal mechanism connected to said spring for adjusting the amount of force applied by said spring on said closure member.

13. In a fuel supply system for an internal combustion engine, the improvement of means for regulating the pressure of fuel being supplied to said engine, comprising a housing having a plunger bore formed therein, a plunger reciprocably mounted in said plunger bore, a centrifugal mechanism adapted to be turned at a rate which is a function of engine speed, said centrifugal mechanism being connected to said plunger and moving said plunger in accordance with changes in engine speed, a main fuel flow passage formed in said housing, a bypass fuel flow passage formed in said housing and communicating with said main fuel flow passage, said bypass fuel flow passage including an opening which is movable with said plunger, a closure member positioned adjacent said plunger at said opening, means mounting said closure member for movement in a first direction toward and away from said plunger to form a space therebetween, force applying means engaging said closure member and urging said closure member toward said plunger so as to close said space, a recess formed in the side of said closure member which faces said plunger, said recess at least partially overlying said opening, fuel in said bypass fuel flow passage exerting pressure over an area of said closure member and moving said closure member away from said plunger to form said space therebetween and thereby to enable the fluid to flow out of said opening and through said space, and means mounting said member for movement relative to said plunger in a second direction which is generally lateral of said first direction in order to vary the amount of said recess which lies outside of said opening, the pressure of the fuel in said bypass fuel flow passage being equal to the force of said force applying means divided by said area, and said area being equivalent to the area of said opening plus any area of said recess which lies outside the margin of said opening.

14. Apparatus as in claim 13, wherein said force applying means comprises a resilient spring and means for adjusting the force applied by said spring on said closure member.

15. Apparatus as in claim 13, wherein said means mounting said member for movement relative to said plunger in a second direction operates in response to movement of said plunger and said closure member.

* * * * *